US006704978B1

(12) United States Patent
Mathieu et al.

(10) Patent No.: US 6,704,978 B1
(45) Date of Patent: Mar. 16, 2004

(54) METHOD AND DEVICE FOR GUIDING A WEB OF MATERIAL

(75) Inventors: Dieter Mathieu, Ottweiler (DE); Wolfgang Rasp, Prien Chiemsee (DE)

(73) Assignee: Trespaphan GmbH, Neunkirchen (DE)

( * ) Notice: Subject to any disclaimer, the term of this patent is extended or adjusted under 35 U.S.C. 154(b) by 147 days.

(21) Appl. No.: 10/049,457

(22) PCT Filed: Aug. 9, 2000

(86) PCT No.: PCT/EP00/07721

§ 371 (c)(1),
(2), (4) Date: Apr. 23, 2002

(87) PCT Pub. No.: WO01/12418

PCT Pub. Date: Feb. 22, 2001

(30) Foreign Application Priority Data

Aug. 16, 1999 (DE) ..... 199 38 165

(51) Int. Cl.[7] ..... D06C 3/06
(52) U.S. Cl. ..... 26/97; 26/77
(58) Field of Search ..... 26/97, 90, 88, 26/89, 91, 98, 99, 101, 102, 105, 72, 74, 76, 77, 51.3, 51.4; 264/290.2; 226/17; 425/66

(56) References Cited

U.S. PATENT DOCUMENTS

| | | | | | |
|---|---|---|---|---|---|
| 2,096,087 | A | * | 10/1937 | Coolidge | 26/77 |
| 3,156,396 | A | * | 11/1964 | Snyder et al. | 226/17 |
| 3,586,229 | A | * | 6/1971 | Kamada et al. | 26/97 |
| 3,637,121 | A | * | 1/1972 | Alexeff | 26/77 |
| 3,650,000 | A | * | 3/1972 | Alexeff et al. | 26/77 |
| 3,673,647 | A | * | 7/1972 | Koster | 26/97 |
| 3,807,004 | A | | 4/1974 | Anderson | 26/59 |
| 3,838,481 | A | * | 10/1974 | Kuroda | 26/77 |
| 3,884,748 | A | * | 5/1975 | Andersen et al. | 264/290.2 |
| 4,140,574 | A | * | 2/1979 | Justus | 26/97 |
| 4,331,624 | A | * | 5/1982 | Yazawa et al. | 264/290.2 |
| 4,726,501 | A | * | 2/1988 | Wiley | 26/77 |
| 5,560,793 | A | | 10/1996 | Ruscher et al. | 156/73.1 |
| 5,791,030 | A | * | 8/1998 | Aihara et al. | 26/97 |

FOREIGN PATENT DOCUMENTS

| | | |
|---|---|---|
| DE | 1 803 860 | 5/1970 |
| EP | 0 009 294 A1 | 4/1980 |

OTHER PUBLICATIONS

Patent Abstract for JP 57–160614, one page, Oct., 1992.

* cited by examiner

*Primary Examiner*—Amy B. Vanatta
(74) *Attorney, Agent, or Firm*—Howson and Howson

(57) ABSTRACT

The present invention relates to a method for guiding a flat web of material (1) in which the web of material (1) runs in an arrangement of rotating rollers at a web speed $v_F$. The web of material is guided in its peripheral region via a spreader roll (2) which produces a tensile stress in the transverse direction, i.e. crosswise relative to the machine direction of the web of material (1), wherein this tension in the transverse direction is controlled by means of closed-loop control of the circumferential speed $v_R$ of the spreader roll (2) and/or by open-loop control of the cant angle α and/or of the wrap angle β between the surface of the spreader roll (3) and the web of material (1) and wherein the circumferential speed $v_R$ is greater than the web speed $v_F$.

20 Claims, 5 Drawing Sheets

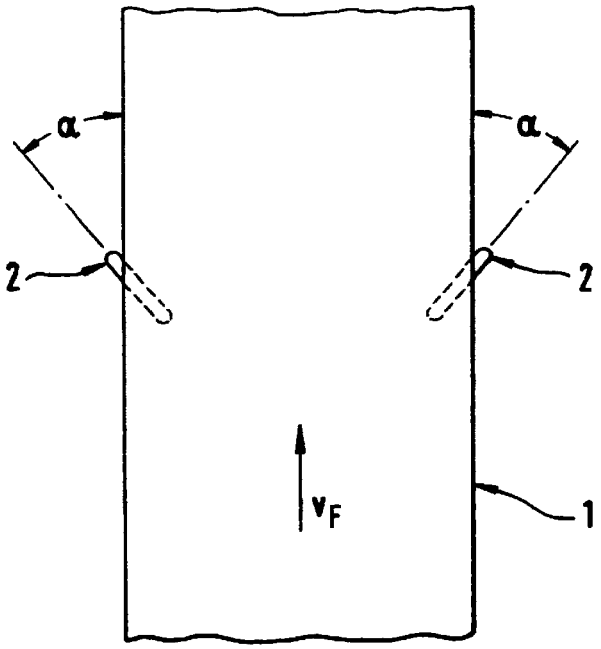
Fig. 5
Fig. 6
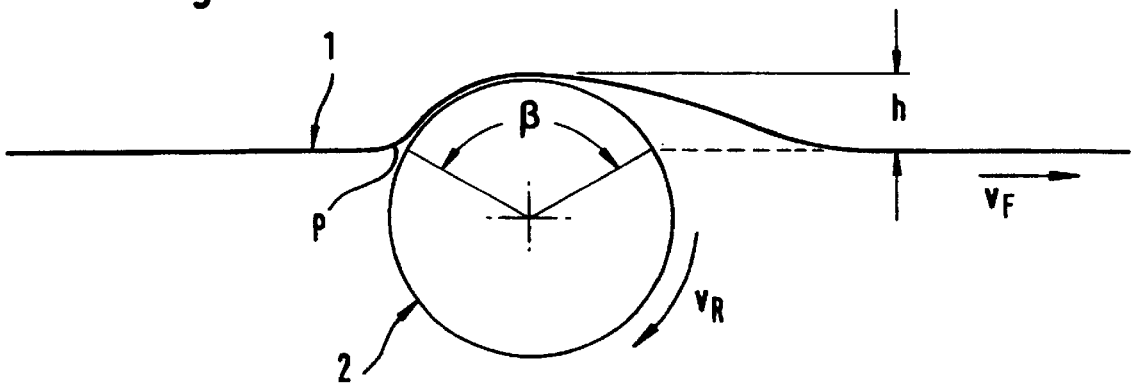

METHOD AND DEVICE FOR GUIDING A WEB OF MATERIAL

FIELD OF THE INVENTION

The present invention relates to a method and a device for guiding a web of material (1) which is guided and transported between rotating rollers.

BACKGROUND OF THE INVENTION

In the production and the processing of flat webs of material these webs are guided and transported between rotating rollers. In order to transport the web a certain level of tension is produced in the longitudinal direction of the web of material. Due to this tension in the direction of travel, folds or shifts arise in the longitudinal direction which are undesired and which later produce lateral elongations in the reel which may result in the material being completely unusable. Accordingly, it is necessary to smooth and straighten the folds and shifts in the running web of material brought about by the tensile stress in the longitudinal direction by means of tensile forces in the crosswise direction.

Devices for spreading webs of material are known in the state of the art. US 22 89 196 describes what is referred to as the banana roller. This cylindrical roller is composed at least on the surface of an elastomeric material and is specially shaped. The roller is curved over its entire length and is pressed against the running web of material. When the roller is pressed into the running web of material, the shape of the roller causes spreading in the transverse direction. However, the transmission of force by transverse forces that can thus be generated and the transverse movement achievable in this case is extremely small and, therefore, unusable for many applications.

OBJECTS OF THE INVENTION

The underlying aim of the present invention is to provide a method and a device for spreading a flat web of material (1) which is guided and transported via rollers. The method is intended to ensure that the web of material (1) can be guided and transported without folds and elongations in the longitudinal and transverse directions. At the same time it is of particular importance that the method can be adapted, i.e. the method should be equally successfully employed at different speeds of travel of the web of material (1) and for different materials. In addition the device should require low maintenance and have little need for repair.

SUMMARY OF THE INVENTION

This task is solved by a method for guiding a flat web of material (1) in which the web of material (1) runs in an arrangement of rotating rollers at a web speed $v_F$ and the web of material (1) is guided in both peripheral regions via at least one spreader roll (2) which produces a tensile stress in the transverse direction, i.e. crosswise relative to the direction of travel of the web of material (1), wherein this tension in the transverse direction is controlled by closed-loop control of the circumferential speed $v_R$ of the spreader roll (2) and/or by open-loop control of the angle and/or the contact surface area (3) between the surface of the roll (5) and the web of material (1) and wherein the circumferential speed of the spreader roll (2) $v_R$ is greater than the web speed $v_F$.

BRIEF DESCRIPTION OF THE DRAWINGS

FIG. 5 is a schematic illustration of the positional possibilities of the spreader rolls (2) as a function of the angle a to the web of material (1). $V_F$ represents the web speed and the arrow specifies the direction of travel of the web of material (1).

FIG. 6 is a schematic illustration in side elevation of the web of material (1) which is guided via the spreader roll (2). The angle β results from the point of incidence p of the web of material (1) on the spreader roll (2) and the backward extrapolation shown by a dotted line of the web of material (1) behind the spreader roll (2). The depth of insertion of the spreader roll (2) into the web of material (1) is designated by h. The direction of rotation of the spreader roll (2) and the direction of travel of the web of material (1) are indicated by the arrows. $V_R$ and $V_F$ respectively designate their speeds.

FIG. 7 is a perspective illustration of the positioning of the spreader rolls (2) relative to the web of material (1) as a function of the angle α. The arrangement of the discharge electrodes (4) is also sketched in.

DETAILED DESCRIPTION OF THE INVENTION

Figures 1, 1A, 2:
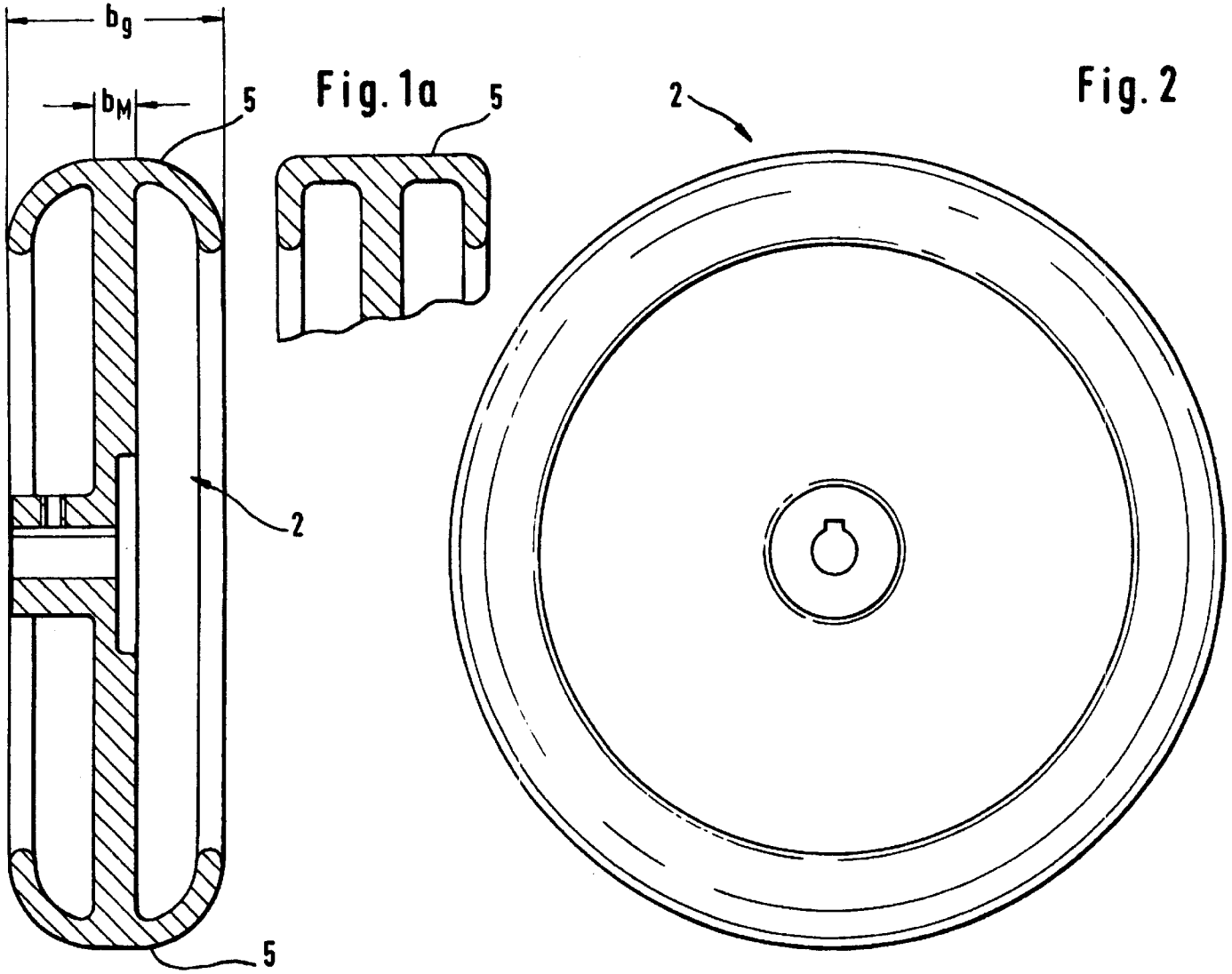
FIG. 1 shows a schematic cross-sectional view of the spreader roll (2), $b_g$ being the overall width of the spreader roll (2) and $b_M$ being the hub face of the roll.
FIG. 1*a* shows a particular embodiment of the spreader roll (2) likewise in schematic cross-sectional view in which the surface of the roll (5) is not chamfered and is, accordingly, particularly wide.
FIG. 2 shows the spreader roll (2) in side elevation.
Figure 3:
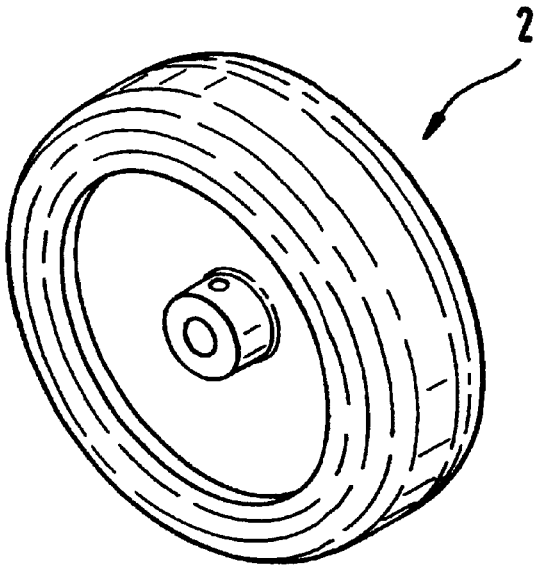
FIG. 3 shows the spreader roll (2) from FIG. 1 in perspective view.
Figure 3A:
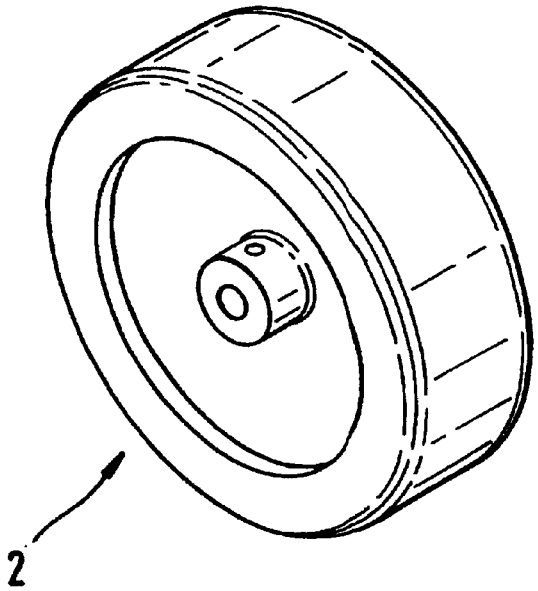
FIG. 3*a* shows the spreader roll (2) from FIG. 1*a* in perspective view.
Figure 4:
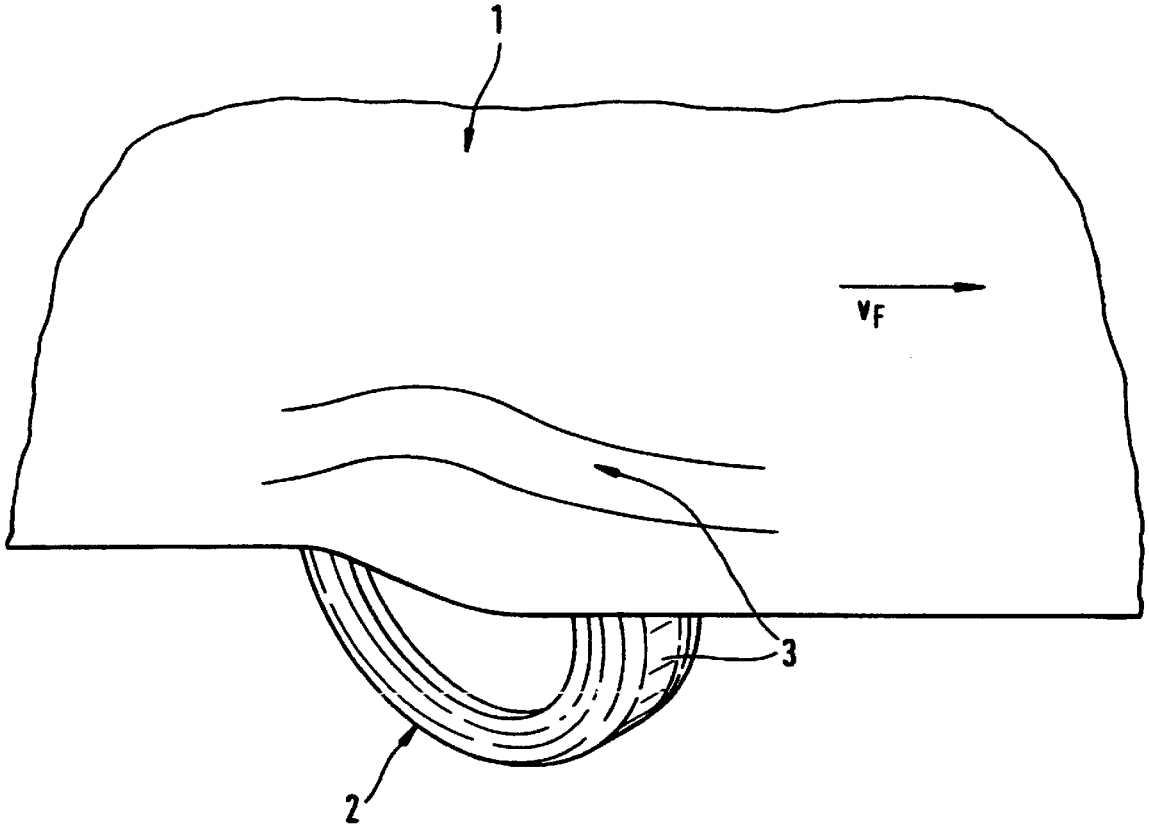
FIG. 4 illustrates the contact surface (3) of the spreader roll (2) on the web of material (1).

The longitudinal direction as defined in the present invention is the direction in which the web of material (1) runs; this direction is also referred to as the machine direction. As defined in the present invention the transverse direction is that direction running at an angle of 90°, i.e. crosswise, to the machine direction.

In the production and processing of flat webs of material these webs are guided in an arrangement of rotating rollers. The circumferential speeds of the individual rollers are controlled and determine, on the one hand, the speed at which the web runs and, on the other hand, the different roller speeds also predetermine a tension which is introduced in the longitudinal direction of the web of material. This tension in the longitudinal direction is necessary in order to ensure undisturbed passage of the web of material over the rollers and the downstream devices integrated in the roller arrangement such as thickness gauges, corona station or the like.

The method according to the invention overcomes the disadvantages which arise due to the tension introduced in the longitudinal direction. The method is suitable for various flat webs of material and can advantageously be employed in all cases in which fold formation or shifts occur in the longitudinal direction of the web of material when guided over and between rotating rollers. The method has proved to be effective in particular for films made from plastics, in particular thermoplastics. Films made from thermoplastic materials include for example films made from polyester and polyolefins, such as polyethylenes, polypropylenes and cycloolefins, polycarbonate, polyamides, etc. Such films can be of single-layered or multi-layered construction. The method can also be applied for webs made of other materials, for example webs of fabric, paper or metal. The method is equally advantageous in the production of laminates or for guiding the laminate itself. Different materials are also possible for the laminates. The method is particularly suitable for webs of material having a thickness of 0.5 to 500 $\mu$m, preferably 2 to 200 $\mu$m.

The web speed $v_F$ of the web of material is determined by the target production or processing speed. Depending on the type of material the usual web speeds are between 1 to 2,500 m/min, preferably 5 to 1,000 m/min. For films made from thermoplastic polymers speeds of 100 to 1,000 m/min are usual. On the one hand, the tension in the longitudinal direction to be introduced into the web of material is determined by the properties of the material (e.g. type of material) and its thickness or the purpose of the following devices (e.g. thickness gauge, surface treatment, winding station) which are integrated in the roller arrangement or arranged downstream and, on the other hand, the web speed $v_F$ itself and the tension to be applied in the machine direction are mutually interdependent. Due to the air entrained by the web of material, air cushions between the roller and web of material build up ahead of the rollers which must be pushed away by the tension introduced into the web of material. The higher the web speed the more easily do unwanted air cushions form and the higher in general the tensile stress in the longitudinal direction has to be to pinch off these cushions. Thus, web speed and tension are given parameters in production or processing operations which can be varied only within a limited range, even when folds and shifts in the longitudinal direction occur. These problems are efficiently overcome by the method according to the invention, wherein web speed and tension can be kept within the desired range.

Accordingly, the method according to the invention is particularly advantageous for production or processing operations involving high web speeds.

According to the invention, the web of material (1) is guided in its peripheral region over one or more spreader rolls (2). The peripheral region of a web of material (1) is usually narrow in relation to the total width of the web. The exact width of such a peripheral region will depend on the nature of the material and the overall width of the web. Generally, a peripheral region is understood to be the outer regions of the web which together may account for up to 30% of the total width. As a rule each peripheral region amounts to 1 to 10% of the total width of the web of material. It is a matter of course that every continuous web of material has two edges which run parallel to the machine direction. The following details about "the peripheral region" naturally apply also in equivalent manner to the corresponding opposite edge.

The web of material (1) is guided in the peripheral region over a spreader roll (2). This spreader roll (2) is of such a size that its diameter is usually greater than its width $b_g$ so that the term "roll" more aptly characterizes the element than the term "roller". It is, however, not ruled out that appropriately sized rollers may also fulfill an equivalent purpose. The person skilled in the art will select the size of the element as a function of the web of material (1), the web speed and the width of the peripheral region. Generally, the spreader roll (2) has a width $b_g$ of 1 to 500 mm, preferably 1 to 150 mm, and in particular 1 to 50 mm. The diameter of the spreader roll (2) is generally 1 to 10% of the width of the web of material (1). The width of the web of material depends on the type of material and the given dimensions of the machine and can, accordingly, vary over a wide range. For films made of thermoplastics, customary web widths in the production of the film prior to transverse orientation range from 0.2 to 2 m, preferably 0.5 to 1 m, but after transverse orientation range from 0.5 to 30 m, preferably 1 to 20 m. The absolute values for the roll diameter may vary correspondingly within broad limits.

In principle the spreader roll (2) can be produced from any material or composite material which meets the requirements. The surface should be designed in such a way that a non-positive connection between the web of material (1) and the surface of the roll (5) is promoted. In a particular embodiment it is necessary to ground the surface electrically to zero potential.

In a preferred embodiment the roll is beveled or chamfered at the edges in such a way that the hub face $b_M$ becomes narrower so that the contact surface area (3) between the web of material (1) and the surface of the roll (5) is reduced in the ideal case to a point or a line. In general, the hub face $b_M$ in beveled or chamfered embodiments will have a width of 0 to 400 mm, preferably 1 to 200 mm. Such beveled or chamfered rolls are particularly advantageous since the relative motion between the hub face $b_M$ and the web of material (1) becomes steadily smaller as the hub face diminishes. In addition, beveled or chamfered rolls afford a certain degree of protection against damage to the web of material (1).

The spreader roll (2) does not necessarily require an independent drive. It can be driven by the running web of material (1) and then has a circumferential speed $v_R$ which corresponds to the web speed $v_F$ of the web of material (1) taking account of the cant angle $\alpha$. In a preferred embodiment the spreader roll (2) is provided with a drive through which the circumferential speed of the roll $V_R$ can be subjected to open-loop or closed-loop control. Spreader rolls driven in this way are preferred. The drive allows the circumferential speed of the roll to be controlled in open-loop or closed-loop fashion and, moreover, allows the tension produced in the crosswise direction to be controlled also. For driven rolls, with the cant angle $\alpha$ being taken into account the circumferential speed $v_R$ can be set in such a way that the circumferential speed $v_R$ is at least just as high as and preferably greater than the web speed $v_F$ of the web of material (1). The lead of the circumferential speed $v_R$ of the roll is usually set in such a way that no relative motion occurs between the surface of the roll (5) and the web of material (1).

In another preferred embodiment the spreader roll (2) has an electrically conducting surface which is grounded to an electric potential of zero. This surface allows a particularly advantageous embodiment of the method according to the invention in which a non-positive connection between the contact surface of the spreader roll (2) and the web of material (1) is achieved by electrostatic charging of the web of material. This embodiment of the method is explained in detail below.

Figure 7:
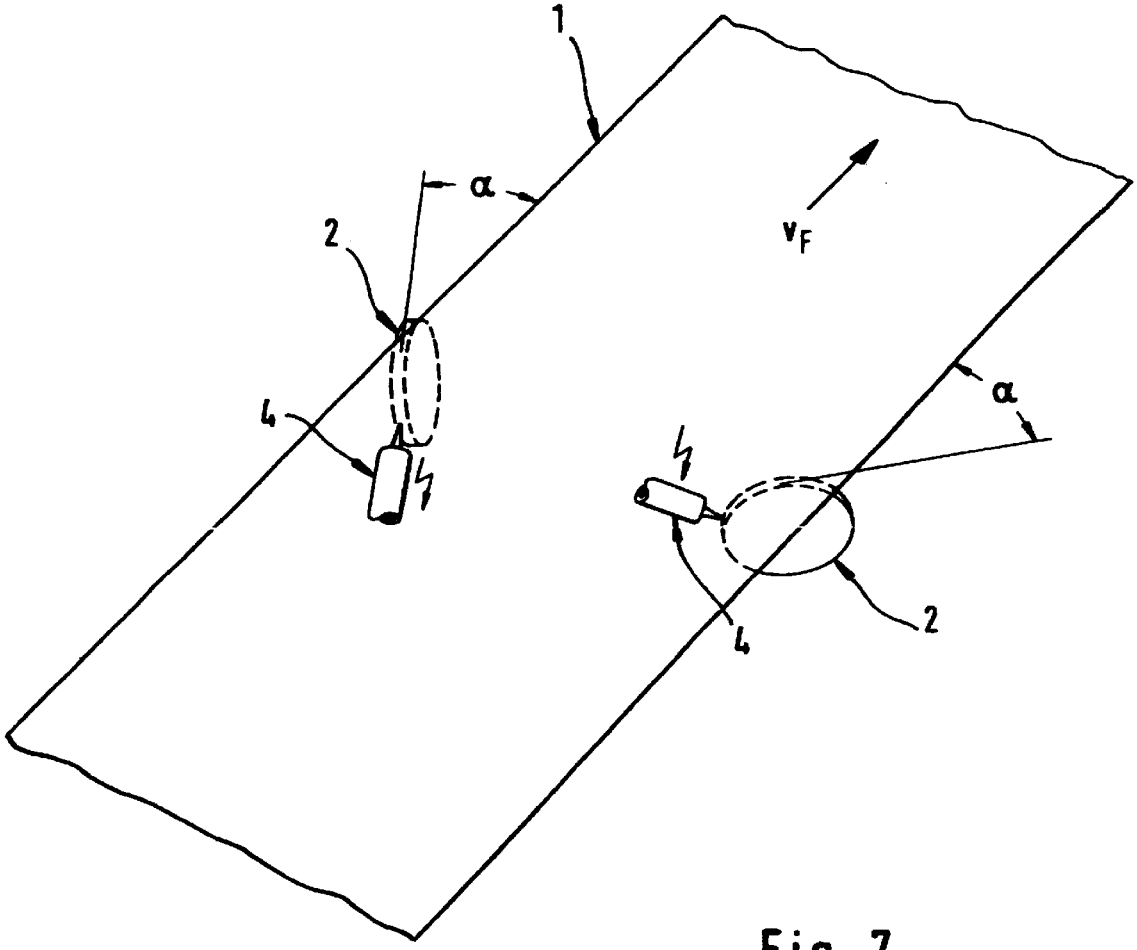

To carry out the method according to the invention the spreader rolls (2) are positioned in the two peripheral regions of the web of material (1). The position of the spreader rolls (2) on the running web of material (1) is chosen on the basis of mechanical engineering and ergonomic considerations. Driven spreader rolls (2) are driven in such a way that they revolve in the machine direction of the web of material (1). To position the roll in relation to the running direction of the web a cant angle $\alpha$ is set (see FIG. 7). This angle must be greater than 0° and less than 90°. In general, a cant angle in the range of 2 to 50°, preferably 5 to 30°, will be set. The speed of the roll $v_R$ is controlled in open-loop or closed-loop manner by the setting of the angle. The settings chosen for the open-loop or closed-loop control of the individual parameters are interdependent. Thus, by way of example, the following relationship between the cant angle $\alpha$ to be set and the circumferential speed of the roll $v_R$:

$$v_R = v_F : \cos.\alpha.$$

Thus, for a larger cant angle $\alpha$ a higher circumferential speed $v_R$ must be selected if there is to be no relative motion between the web of material (1) and the surface of the roll (5).

Finally, the spreader rolls (2) are also positioned in the third possible spatial dimension. The roll must first of all be moved far enough in the direction of the web of material (1) that the surface of the roll (5) plunges into the web of material (1). This positioning is also referred to below as the depth of insertion h (see FIG. 6). The depths of insertion of the spreader roll (2) into the running web of material (1) determine how much the web of material (1) wraps around the spreader roll (2). The higher the wrap angle $\beta$ the greater is the contact surface area (3) produced between the surface of the roll (5) and the web of material (1).

In another particularly advantageous embodiment of the invention the non-positive wrap around the roll is assisted by electrostatic charging of the web of material (1). For this purpose a discharge electrode (4) is fitted in the region of the point of incidence P, viewed in the machine direction of the web of material (1), of the web of material (1) onto the spreader roll (2) (see FIGS. 6 and 7). By means of this discharge electrode (4) an electric charge is applied to a small region of the web of material (1). If the web of material (1) charged in this way then runs over an electrically conducting spreader roll (2) grounded to an electric potential of zero the web of material (1) is attracted by the surface of the spreader roll (5). This results in a particularly good non-positive connection between the web of material (1) and the contact surface (3) and possibly also in a larger wrap angle $\beta$. In this way the person skilled in the art is furnished with a further parameter through which (s)he can regulate the force acting in the transverse direction. The higher the charge voltage the greater is the contact force and possibly the wrap angle $\beta$, due to which in the final analysis any potential slippage between the web of material (1) and the contact surface (3) is eliminated and a transverse force can be built up by advancing the speed of the spreader roll (2).

The invention opens up a simple way of introducing a tensile stress in the crosswise direction of a continuous web of material. This method is particularly advantageous since it affords various possibilities for controlling this tension in the transverse direction. The tensile stress can be controlled by varying the diameter of the roll, by means of the cant angle $\alpha$, by means of the depth of insertion h, by means of the design of the surface of the roll, by means of the circumferential speed, by means of the positioning of the spreader roll relative to the web of material and by means of the static charge. In this way it is possible to very finely adjust the forces acting in the transverse direction via different presettings. The method according to the invention is extremely flexible and can be used advantageously for the most varied materials and production or processing methods. It allows webs of material to be guided without folds through rotating rollers and a controlled tension to be built up in the transverse direction so that shifts or other faults which may arise due to the tensions in the longitudinal direction are reliably prevented.

What is claimed is:

1. A method for guiding a flat web of material (1) in which the web of material (1) runs in a machine direction in an arrangement of rotating rollers at a web speed $v_F$, comprising the step of:

guiding the web of material (1) in its peripheral region with a spreader roll (2) which produces a tensile stress in a transverse direction which is crosswise relative to the machine direction of the web of material (1), wherein this tensile stress in the transverse direction is controlled by at least one of a closed-loop control of a circumferential speed $v_R$ of the spreader roll (2), an open-loop control of a cant angle $\alpha$ of the spreader roll (2) relative to the machine direction, and an open-loop control of a wrap angle $\beta$ of the web of material (1) on the spreader roll (2), and wherein the circumferential speed $v_R$ is greater than the web speed $v_F$.

2. The method according to claim 1, wherein the web of material (1) is a web of material composed of a material selected from the group consisting of thermoplastic, polyester, polyethylene, polycarbonate, polypropylene, and cycloolefin polymer.

3. A method according to claim 1, wherein the web of material (1) has a thickness of 0.5 to 500 $\mu$m.

4. A method according to claim 3, wherein the web of material (1) has a thickness of 2 to 200 $\mu$m.

5. A method according to claim 1, wherein the web speed $v_F$ of the web of material (1) is 1 to 2,000 m/min.

6. A method according to claim 1, wherein the peripheral region of the web of material (1) is 1 to 10% of a total width of the web of material (1).

7. A method according to claim 1, wherein the spreader roll (2) has a diameter in a range of 1 to 500 mm, and wherein the diameter of the spreader roll (2) is greater than a width of the spreader roll (2).

8. A method according to claim 1, wherein the spreader roll (2) has a surface (5) selected from the group consisting of a metallic surface and a conductive surface, and wherein the surface is grounded to an electric potential of zero.

9. A method according to claim 1, wherein the spreader roll (2) has beveled edges.

10. A method according to claim 1, wherein the spreader roll (2) is connected to a drive which controls the circumferential speed $v_R$ of the spreader roll (2).

11. A method according to claim 1, wherein at least two spreader rolls (2) are positioned adjacent a pair of opposite peripheral regions of the web of material (1) and form a cant angle $\alpha$ relative to the machine direction of the web of material (1) that is greater than 0° and less than 90°.

12. A method according to claim 11, wherein said cant angle $\alpha$ of the spreader rolls (2) relative to the machine direction is within a range of 2 to 50°.

13. A method according to claim 1, wherein the spreader roll (2) is engaged with the web of material (1) such that the web of material (1) partially wraps around the spreader roll (2).

14. A method according to claim 13, wherein the web of material (1) engages the spreader roll at a point of incidence (P), wherein the spreader roll (2) has a conductive surface (5), and wherein a discharge electrode located adjacent the point of incidence (P) applies a charge to the web of material (1).

15. A method according to claim 2, wherein the web of material (1) has a thickness of 2 to 200 $\mu$m, wherein the web speed $v_F$ of the web of material (1) is 1 to 2,000 m/min, wherein the peripheral region of the web of material (1) is 1 to 10% of a total width of the web of material (1), wherein the spreader roll (2) has a diameter in a range of 1 to 500 mm, and wherein the diameter of the spreader roll (2) is greater than a width of the spreader roll (2).

16. A method according to claim 15, wherein the spreader roll (2) has a surface (5) selected from the group consisting of a metallic surface and a conductive surface, and wherein the surface is grounded to an electric potential of zero.

17. A method according to claim 16, wherein the spreader roll (2) has beveled edges, and wherein the spreader roll (2) is connected to a drive which controls the circumferential speed $v_R$ of the spreader roll (2).

18. A method according to claim 17, wherein at least two spreader rolls (2) are positioned adjacent a pair of opposite peripheral regions of the web of material (1) and form a cant angle ($\alpha$) relative to the machine direction of the web of material (1) that is within a range of 2 to 50°.

19. A method according to claim 18, wherein the spreader roll (2) is engaged with the web of material (1) such that the web of material (1) partially wraps around the spreader roll (2).

20. A method according to claim 19, wherein the web of material (1) engages the spreader roll at a point of incidence (P), wherein the spreader roll (2) has a conductive surface (5), and wherein a discharge electrode located adjacent the point of incidence (P) applies a charge to the web of material (1).

* * * * *